US009475055B2

(12) United States Patent
Zhu

(10) Patent No.: US 9,475,055 B2
(45) Date of Patent: Oct. 25, 2016

(54) JAW CRUSHER WITH DOUBLE-CRANK-ROCKER MECHANISM

(75) Inventor: Xingliang Zhu, Yiwu (CN)

(73) Assignee: YIWU BLACK-AND-WHITE MINING MACHINERY CO., LTD, Yiwu, Zhejiang (CN)

( * ) Notice: Subject to any disclaimer, the term of this patent is extended or adjusted under 35 U.S.C. 154(b) by 494 days.

(21) Appl. No.: 14/111,558

(22) PCT Filed: Apr. 9, 2012

(86) PCT No.: PCT/CN2012/073685

§ 371 (c)(1),
(2), (4) Date: Oct. 13, 2013

(87) PCT Pub. No.: WO2012/139483

PCT Pub. Date: Oct. 18, 2012

(65) Prior Publication Data

US 2014/0048636 A1 Feb. 20, 2014

(30) Foreign Application Priority Data

Apr. 13, 2011 (CN) ..... 2011 1 0092010
Apr. 13, 2011 (CN) ..... 2011 1 0092031

(51) Int. Cl.
*B02C 1/02* (2006.01)
*B02C 21/02* (2006.01)
*B02C 1/04* (2006.01)

(52) U.S. Cl.
CPC . *B02C 1/02* (2013.01); *B02C 1/04* (2013.01); *B02C 1/043* (2013.01); *B02C 21/02* (2013.01)

(58) Field of Classification Search
CPC ..... B02C 1/04; B02C 1/043; B02C 1/02; B02C 21/02
USPC ..... 241/264–269, 148, 101.74, 101.77, 241/101.742
See application file for complete search history.

(56) References Cited

U.S. PATENT DOCUMENTS 3,425,639 A * 2/1969 Kueneman ..... B02C 1/04 241/148
3,918,648 A * 11/1975 Anthony ..... B02C 1/025 241/268
4,288,040 A * 9/1981 Miller ..... B02C 21/02 241/263
4,398,674 A * 8/1983 Dremann ..... B02C 1/025 241/264
4,989,797 A * 2/1991 DeDiemar ..... B02C 1/04 241/264
5,110,058 A * 5/1992 Rawson ..... B02C 1/005 241/264
5,598,982 A * 2/1997 Betts ..... B02C 1/04 241/264
5,857,630 A * 1/1999 Hamaguchi ..... B02C 1/025 241/259.1
8,322,643 B2 * 12/2012 Gervais ..... B02C 1/04 241/101.742
2004/0129814 A1 * 7/2004 Ha ..... B02C 1/005 241/267
2012/0018558 A1 * 1/2012 Gervais ..... B02C 1/04 241/101.74

* cited by examiner

*Primary Examiner* — Faye Francis

(57) ABSTRACT

A jaw crusher with a double-crank-rocker mechanism includes: a frame (1); a fixed jaw plate (6); a movable jaw plate (5); a crank-rocker device and a driving wheel (2); wherein the crank-rocker device includes a front crank-rocker mechanism; and a rear crank-rocker mechanism. The front and rear crank-rocker mechanisms are provided on the same eccentric drive shaft (3) for forming a jaw crusher with a single eccentric driving shaft, or the front and rear crank-rocker mechanisms are respectively connected to a front eccentric driving shaft (15) and a rear eccentric driving shaft (14) rotating synchronously by the driving wheel (2) for forming a jaw crusher with double eccentric driving shafts. The front and rear crank-rocker mechanisms are utilized for changing mechanical structure characteristics of the bottom of the swinging jaw and greatly improving functionality of the jaw crusher.

10 Claims, 6 Drawing Sheets

JAW CRUSHER WITH DOUBLE-CRANK-ROCKER MECHANISM

CROSS REFERENCE OF RELATED APPLICATION

This is a U.S. National Stage under 35 U.S.C. 371 of the International Application PCT/CN2012/073685, filed Sep. 4, 2012, which claims priority under 35 U.S.C. 119(a-d) to CN 201110092010.9, filed Apr. 13, 2011 and CN 201110092031.0, filed Apr. 13, 2011.

BACKGROUND OF THE PRESENT INVENTION

1. Field of Invention

The present invention relates to a field of jaw crushers, and more particularly to a jaw crusher with a double-crank-rocker mechanism.

2. Description of Related Arts

In present, the most widely used jaw crusher is compound pendulum jaw crusher, which comprises a swinging jaw and a fixed jaw and simulates the movement of animal's jaw for crushing. The jaw crusher is widely used in mining, smelting, building material, highway, railway, water conservancy and chemical industry for moderately crushing ores and bulk materials.

From a mechanical point of view, the conventional jaw crushers (compound pendulum jaw crushers, the same below), have a common typical structure. That is to say, each of the conventional jaw crushers has a crank-rocker mechanism (an eccentric shaft thereof is a crank, the swinging jaw is a connecting rod, and the bracket is a rocker). A side of the swinging jaw forms a V-shaped crushing chamber with a side of a frame. An upper portion of the swinging jaw directly obtains a horizontal crushing stroke from an eccentric driving shaft. A lower portion of the swinging jaw provides a circular motion by the swinging jaw for driving the bracket to swing in such a manner that a horizontal crushing power stroke and a material discharge stroke are provided. The structure is simple and easy to manufacture, which makes the jaw crusher the most widely used crusher. But the disadvantage is that with the mechanism, the horizontal crushing stroke and the material discharge stroke provided by the swinging bracket driven by an upward pulling force of the swinging jaw contradict the crushing force and the discharge. That is to say, when great crushing capacity is required, the material discharge capacity has a trend of being zero, and when great material discharge capacity is required, the crushing capacity drops dramatically.

The above contradiction is determined by mechanical principle of the structure. Referring to FIG. 1 of the drawings, a sketch view of a conventional jaw crusher is illustrated. The conventional jaw crusher comprises: a frame 1, an eccentric driving shaft 3, a fixed jaw plate 6, a movable jaw plate 5, a front swinging jaw 4, a front bracket 7 and a driving wheel 2. An upper portion of the swinging jaw 4 directly obtains a horizontal crushing stroke from the eccentric driving shaft 3. A lower portion of the swinging jaw 4 drives the bracket front 7 to swing by the eccentric driving shaft 3 in such a manner that a horizontal crushing power stroke and a material discharge stroke are provided. When a transmission angle of the front bracket 7 is maximized (referring to FIG. 3 and FIG. 4 of the drawings) or minimized (referring to FIG. 5 and FIG. 6 of the drawings), a swinging jaw tension F1 and a front bracket thrust F2 form a composition force F3. The F3 can be resolved into a vertical force F5 and a horizontal force F4, wherein the F4 is an effective crushing force. Obviously, the F4 is much smaller than the F1 as long as the transmission angle $\theta<90°$, and a movement of the lower portion of the swinging jaw is always in a state of force reduction effect. In addition, we can see that an upper stop point M2 and a lower stop point M1 of the front swinging jaw forms a horizontal stroke S. A horizontal stroke S1 under the maximized transmission angle is less than a horizontal stroke S2 under the minimized transmission angle. However, the F4 under the maximized transmission angle is greater than the F'4 under the minimized transmission angle.

For a higher yield, discharge stroke may be set to max. Although this is conducive to the discharge of materials, the horizontal crushing force is in a state of max force reduction effect, which is very prejudicial to crushing. This is a contradiction. That is to say, when crushing capacity is high, the material discharge capacity is low; and when material discharge capacity is high, the crushing capacity is low.

Since the jaw crusher was developed, a lot of improvements and innovations have been achieved, and a large number of inventions and utility model patents have been published. But the above disadvantages have not been solved. For example, in Chinese patent ZL 02130566.8, wearing strength of parts is improved and adjustment is easier, but the problem of force reduction effect is not solved.

In Chinese patent ZL 200810043629, the bracket is replaced by a toggle rod. Only the structure and force conditions are changed. And the contradiction of crushing force and discharge still exists.

In short, the movement of the lower portion of the swinging jaw of the conventional jaw crusher is mainly set to discharging. Therefore, the movement of the lower portion of the swinging jaw is material discharge stroke rather than material crushing stroke. Although with a little crushing effect, which is quite little, the power loss is very high (due to the force reduction effect). These are the disadvantages and shortcomings of the conventional jaw crusher.

Mechanical characteristics of the crank-rocker mechanism the conventional jaw crusher determines that working and discharging of the lower portion of the swinging jaw are not compatible with each other. For guaranteeing a certain yield, the transmission angle will be set to min. This results in:

A) the force reduction effect is maximized and crushing function is severely limited; and even jamming will be occurred, which can seriously reduce the crushing effect (and that's why the jaw crusher is a coarse crusher).

B) the force reduction effect causes power loss which reduces the crushing efficiency, or economic efficiency.

SUMMARY OF THE PRESENT INVENTION

An object of the present invention is to provide a jaw crusher with a double-crank-rocker mechanism for overcoming a disadvantage of a conventional jaw crusher that only discharging materials is a main object, wherein the jaw crusher promotes a discharging function to a crushing function, provides a movement of a lower portion of a swinging jaw that is not only a force-increasing crushing stoke, but also a large discharging stoke, solves a contradiction of discharging and crushing of the conventional jaw crusher, and provides a secondary crushing function.

Accordingly, in order to accomplish the above object, the present invention provides a jaw crusher with a double-crank-rocker mechanism, comprising:

a frame;

a fixed jaw plate;

a movable jaw plate;

a crank-rocker device; and a driving wheel;

wherein the fixed jaw plate is mounted on the frame, the movable jaw plate is mounted on the crank-rocker device, the crank-rocker device is provided on the frame and is connected to the driving wheel;

wherein the crank rocker device comprises:

a front crank-rocker mechanism; and a rear crank-rocker mechanism;

wherein the front crank-rocker mechanism comprises:

a front swinging jaw; and a front bracket;

wherein the rear crank-rocker mechanism comprises:

a rear swinging jaw; and a rear bracket;

wherein the front swinging jaw and the rear swinging jaw are connected to an eccentric drive mechanism, the eccentric drive mechanism is connected to the driving wheel; a first end of the front bracket is pivotally connected to a bottom rear of the front swinging jaw, a second end of the front bracket is pivotally connected to a bottom front of the rear swinging jaw; a first end of the rear bracket is pivotally connected to a bottom rear of the rear swinging jaw, a second end of the rear bracket is pivotally connected to the frame; the movable jaw plate is mounted on the front swinging jaw and is corresponding to the fixed jaw plate for forming a crushing chamber.

The jaw crusher according to the present invention comprises two complete and independent crank-rocker mechanisms, wherein:

A) in the front crank-rocker mechanism, the eccentric drive mechanism is a crank, the front swinging jaw is a connecting rod, and the front bracket is a rocker; and B) in the rear crank-rocker mechanism, the eccentric drive mechanism is a crank, the rear swinging jaw is a connecting rod, and the rear bracket is a rocker.

The front crank-rocker mechanism cooperates with the rear crank-rocker mechanism for breaking and pulling backwards a pivotal connection point of the front bracket and the frame. The rear crank-rocker mechanism is inserted. The bottom rear of the rear swinging jaw is pivotally connected to the front bracket. The rear bracket is pivotally connected to the frame. Because the front eccentric drive mechanism and the rear eccentric drive mechanism rotate synchronously by a same shaft or a driving wheel, the double-crank-rocker mechanism is formed.

The double-crank-rocker mechanism changes a state of the bottom the conventional swinging jaw from force reduction effect to force increasing effect. Force analysis is as follows:

A) The force analysis of the conventional swinging jaw is illustrated in FIG. 2 of the drawings, wherein a swinging jaw tension F1 and a front bracket thrust F2 form a composition force F3. The F3 can be resolved into a vertical force F5 and a horizontal force F4, wherein the F4 is an effective crushing force. Obviously, the F4 is much smaller than the F1. Therefore, a movement of the lower portion of the swinging jaw is always in the state of force reduction effect. And B) The force analysis of the bottom of the swinging jaw according to the present invention is illustrated in the FIG. 9 of the drawings, wherein for conveniently analyzing and comparing, the rear bracket is removed, and only the front bracket is analyzed (whose results are the same as the rear bracket). Because an end of the rear bracket is pivotally connected to the frame (which is also called relatively mounting), line AB in the FIG. 9 is approximately regarded as a straight track (which is actually a curve) for forcing a zero point to move up and down. According to the mechanical principle (parallelogram law), a swinging jaw tension F6 and an AB track thrust F7 form a composition force F8. The F8 can be resolved into a vertical force F9 and a horizontal force F10, wherein the F9 is an effective crushing force. The F10 equals to F6 in value. Obviously, the F9 is larger than the F6. Therefore, a movement of the lower portion of the swinging jaw is always in the state of force increasing effect (because an angle β is large).

The above results show that with the double-crank-rocker mechanism, a small force on the rear swinging jaw will lead to a large (horizontal) crushing force on the bottom of the front swinging jaw. The higher the rear swinging jaw is (which means the β is larger), the more the crushing force will be increased. This characteristic is very suitable for actual utilization: wherein with the later crushing stroke, the materials are more compact, and the larger crushing force is needed. If the crushing force is large enough, crushing efficiency will be the best.

A design of the crank-rocker mechanism is changed to a design of the double-crank-rocker mechanism, which is a highlight and a structural characteristic of the present invention.

Unobvious functional characteristic of the present invention is that: limits of the conventional compound pendulum jaw crusher due to the single crank-rocker mechanism are broken; the front and rear crank-rocker mechanisms are utilized for changing mechanical structure characteristics of the bottom of the front swinging jaw; and the force reduction effect is replaced by the force increasing effect for greatly improving functionality of the jaw crusher.

The structure of the jaw crusher is changed from the traditional crank-rocker mechanism to the double-crank-rocker mechanism, which is a revolutionary breakthrough in development history of the jaw crusher.

The core technology of the present invention is changing the force reduction effect of the bottom of the jaw crusher to the force increasing effect with the double-crank-rocker mechanism for changing the discharge stroke (referring to the horizontal movement of the bottom of the swinging jaw) into the crushing stroke, wherein discharge is naturally provided in crushing procedure (which means the procedure is the crushing stroke as well as the discharge stroke). The front crank-rocker-mechanism is mainly for providing crushing of the top of the front swinging jaw, the rear crank-rocker mechanism is mainly for providing crushing and discharge of the bottom of the front swinging jaw. Therefore, the jaw crusher has a function equivalent to the secondary crushing.

The eccentric drive mechanism can be designed as an uniaxial structure or a biaxial structure: that is to say the eccentric drive mechanism can has a structure with single eccentric driving shaft or with double eccentric shafts.

Preferably, the eccentric drive mechanism is a single-eccentric-shaft drive structure comprising:

an eccentric driving shaft, wherein the front swinging jaw and the rear swing jaw are pivotally connected to the eccentric driving shaft, the eccentric driving shaft is connected to the driving wheel;

wherein the eccentric driving shaft comprises:

a shaft cover; and an eccentric shaft bar;

wherein the front swinging jaw is connected to the shaft cover, a camber is provided on a middle of the shaft cover where the eccentric shaft bar is connect, a bearing bush is provided on the eccentric shaft bar in the chamber, the rear swinging jaw is connected to the bearing bush; an opening is provided on the shaft cover, and the rear swinging jaw is capable of passing and swinging through the opening.

With the foregoing structure, the jaw crusher with the uniaxial double-crank-rocker mechanism is formed.

According to the present invention, the camber formed by shaft cover and the eccentric shaft bar of the conventional structure is well utilized. The bearing bush is provided on the eccentric shaft bar in the camber for providing a function of double-eccentric-drive in such a manner that the two set of the crank-rocker structures can be driven, the cost can be lowered and the efficiency can be improved.

In addition, the opening is provided on the shaft cover, and the rear swinging jaw is capable of passing and swinging through the opening. With the foregoing structure, the double-crank-rocker structure can be simplified, which is conducive to upgrading the conventional jaw crushers, promoting product performance and saving resources.

Preferably, the eccentric driving shaft is a self-balance eccentric shaft, a connection guard is provided in a middle of the eccentric driving shaft, a bearing bush of the rear swinging jaw is cased around the connection guard; eccentric bearing guards, concentric bearing guards, locking guards and reference guards are provided equally at two sides of the connection guard; a first shaft cover and a second shaft cover are provided on the front swinging jaw and are respectively connected to the eccentric bearing guards; the concentric bearing guards of the eccentric driving shaft are mounted on the frame; the driving wheel is cased around the reference guards; axes of the concentric bearing guards, the locking guards and the reference guards coincide with a rotation axis of a total shaft, axes of the eccentric bearing guards coincide with an eccentric axis of the total shaft; a center of mass of the connection guard is provided on an opposite side of an eccentric center of the eccentric bearing guard, and an eccentric moment of the connection guard equals to an eccentric moment of the eccentric bearing guard. The axis of the connection guard of the eccentric shaft is reserved (or in line with the rotation axis) for being opposite to the axis of bearing guard of the eccentric shaft. By balance of reverse eccentric inertia moment, the self-balance function is provided.

Preferably, the eccentric drive mechanism is a double-eccentric-shaft drive structure, comprising:

a front eccentric driving shaft; and a rear eccentric driving shaft;

wherein the front swinging jaw is connected to the front eccentric driving shaft, the rear swing jaw is connected to the rear eccentric driving shaft, the front eccentric driving shaft and the rear eccentric driving shaft are respectively connected to the driving wheel.

The driving wheel comprises:

a front driving gear; and a rear driving gear;

wherein the front driving gear is engaged with the rear driving gear, the front eccentric driving shaft is connected to the front driving gear, the rear eccentric driving shaft is connected to the rear driving gear.

With the foregoing structure, the jaw crusher with the biaxial double-crank-rocker mechanism is formed.

The double-crank-rocker mechanism takes full advantages of the two driving wheels. The two driving wheels are engaged with each other and rotate synchronously. The foregoing structure has advantages as follows:

A) By choosing different gear radii for the two gears, various speed ratios (of the two eccentric driving shafts) can be provided for the jaw crusher, which can provide jaw crushers with different functions.

B) The phase angles of the two eccentric drivers can be adjusted easily (by pulling out one of the driving gear, changing the angle and pushing back) for a variety of functions. And C) The rear swinging jaw can be provided vertically for forming a structure with the best force increasing effect with the front and rear bracket. That is to say, a small upward force on the rear swinging jaw will lead to an enlarged force on the front swinging jaw for increasing a crushing ability.

With the above preferred embodiments, synchronous drive can be provided with a synchronous machine and a numerical control system in such a manner that the two driving gears rotate synchronously.

Preferably, the front eccentric driving shaft has a same structure as the rear eccentric driving shaft, the front eccentric driving shaft and the rear eccentric driving shaft are self-balance eccentric shafts, connection guards are provided in middles of the eccentric driving shafts; eccentric bearing guards, concentric bearing guards, locking guards and reference guards are provided equally at two sides of the connection guard; the front swinging jaw is connected to the eccentric bearing guards of the front eccentric driving shaft, the rear swinging jaw is connected to the eccentric bearing guards of the rear eccentric driving shaft; the concentric bearing guards of the eccentric driving shafts are mounted on the frame; the front driving gear is cased around the reference guards of the front eccentric driving shaft, the rear driving gear is cased around the reference guards of the rear eccentric driving shaft; axes of the concentric bearing guards, the locking guards and the reference guards coincide with a rotation axis of a total shaft, axes of the eccentric bearing guards coincide with an eccentric axis of the total shaft; a center of mass of the connection guard is provided on an opposite side of an eccentric center of the eccentric bearing guard, and an eccentric moment of the connection guard equals to an eccentric moment of the eccentric bearing guard.

The axis of the connection guard of the eccentric shaft is reserved (or in line with the rotation axis) for being opposite to the axis of bearing guard of the eccentric shaft. By balance of reverse eccentric inertia moment, the self-balance function is provided. With the foregoing structure, the jaw crusher according to the present invention has advantage as follows:

A) a simplified crushing structure, wherein fly wheel balance weights are not needed and a production cost is saved; as a result, an operation cost is saved;

B) saving power, wherein the two power consumption factors are eliminated and the work efficiency is improved because the self-balance function is provided, the fly wheel balance weights are not needed; and C) improved vibration balance accuracy of the jaw crusher, wherein only the eccentric shaft should be examined because of an accurate design and manufacture of the self-balance eccentric shaft; the jaw crusher doesn't need to be examined and can be fine-tuned easily.

Preferably, an adjusting bolt is provided on the frame. The adjusting bolt is connected to the rear bracket. By operating the adjusting bolt for adjusting the double-crank-rocker mechanism, the mechanism can work more sufficiently.

Preferably, a connecting rod is connected to the front swinging jaw. The connecting rod is connected to the frame through a buffer spring for forming a buffer device in such a manner that inertia of the bracket is reduced and the crushing ability is fully provided.

Therefore, the limits of the conventional compound pendulum jaw crusher due to the single crank-rocker mechanism are broken. The front and rear crank-rocker mechanisms are utilized for changing mechanical structure characteristics of the bottom of the front swinging jaw. And the force reduction effect is replaced by the force increasing effect. A contradiction of the discharge and crushing is eliminated in such a manner that the jaw crusher has a secondary crushing function. The crushing ratio is increased for crushing more finely and evenly. Furthermore, efficiency of the jaw crusher is greatly improved.

These and other objectives, features, and advantages of the present invention will become apparent from the following detailed description, the accompanying drawings, and the appended claims.

Figure 1:
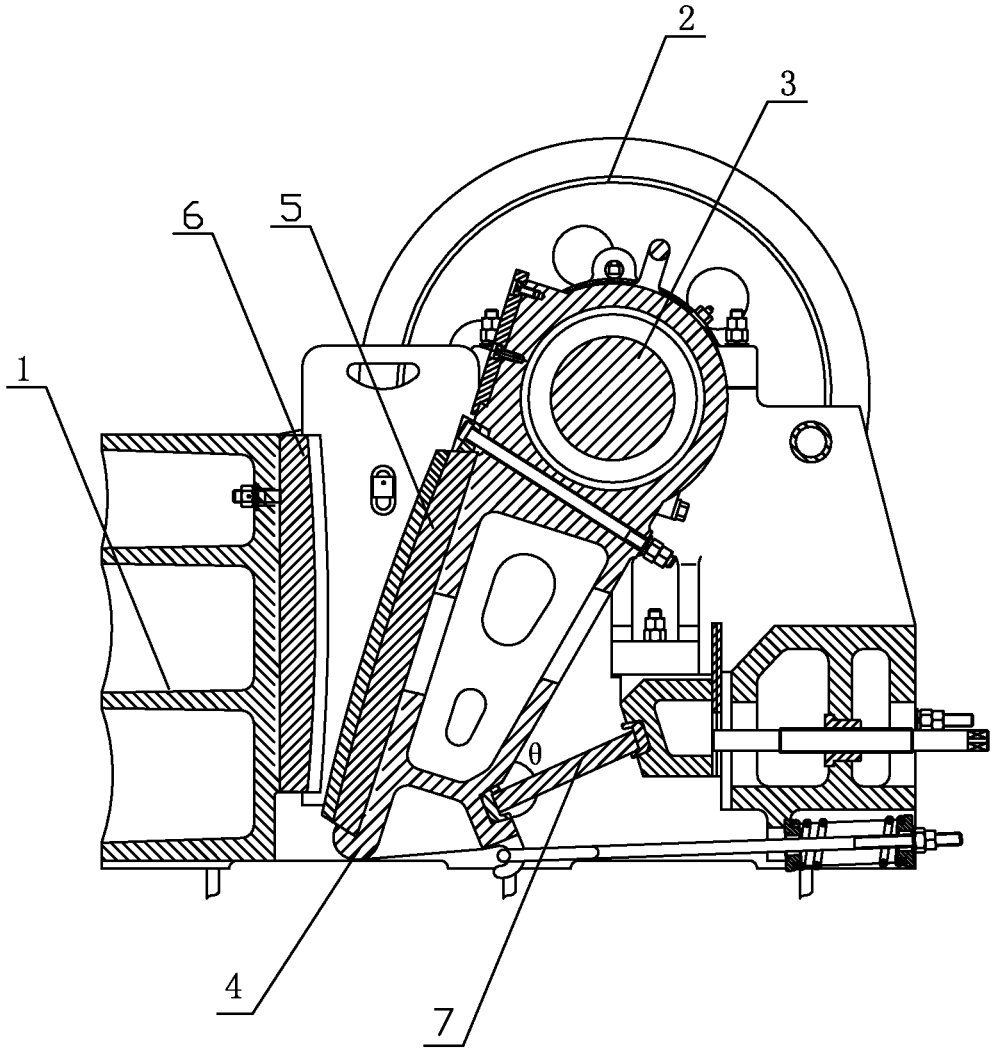
Fig. 1 (prior art)
FIG. 1 is a sketch view of a jaw crusher according to a prior art.
Figure 2:
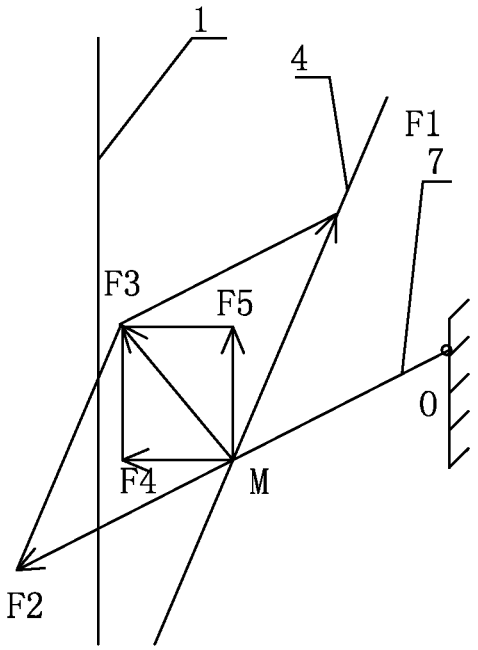
Fig. 2 (prior art)
FIG. 2 is a force analysis of a bottom of a swinging jaw of a jaw crusher according to the prior art.
Figure 3:
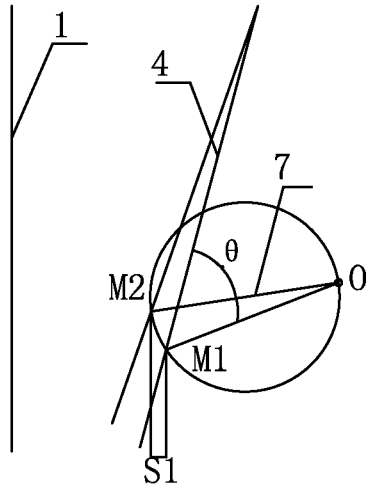
Fig. 3 (prior art)
FIG. 3 is a sketch view of a stroke state when a rotation angle is large according to the prior art.
Figure 4:
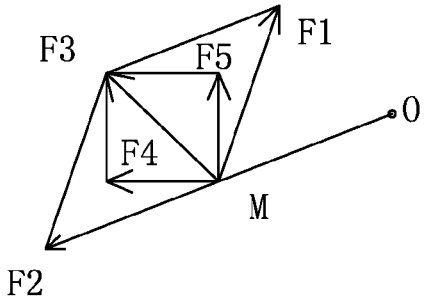
Fig.4 (prior art)
FIG. 4 is a force analysis of the jaw crusher in the FIG. 3 according to the prior art.
Figure 5:
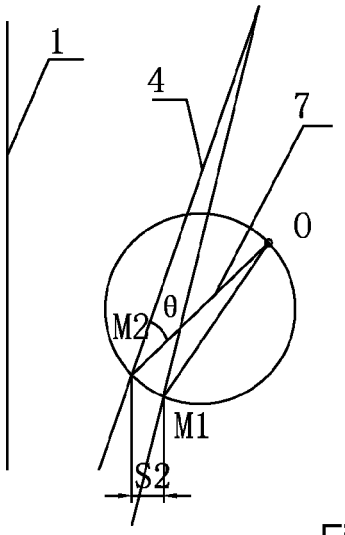
Fig. 5 (prior art)
FIG. 5 is a state sketch view of a stroke when a rotation angle is small according to the prior art.
Figure 6:
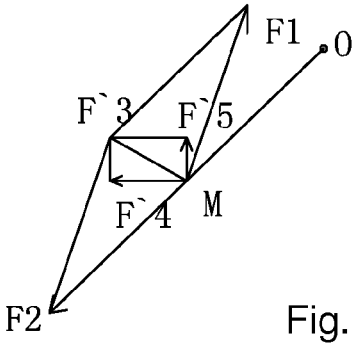
Fig. 6 (prior art)
FIG. 6 is a force analysis of the jaw crusher in the FIG. 5 according to the prior art.

Reference numbers of elements: 1—frame, 2—driving wheel, 21—front driving gear, 3—eccentric driving shaft, 4—front swinging jaw, 5—movable jaw plate, 6—fixed jaw plate, 7—front bracket, 8—rear swinging jaw, 9—rear bracket, 10—connecting rod, 11—buffer spring, 12—adjusting bolt, 13, rear driving gear, 14—rear eccentric driving shaft, 15—front eccentric driving shaft, 16—standard guard, 17—locking guard, 18—eccentric bearing guard, 19—concentric bearing guard, 20—connection guard, 31—shaft cover, 32—eccentric shaft bar, 33—bearing bush, 34—camber, 35—opening.

DETAILED DESCRIPTION OF THE PREFERRED EMBODIMENT

Referring to the drawings, jaw crushers according to preferred embodiments of the present invention is further illustrated.

Preferred Embodiment 1

Figure 7:
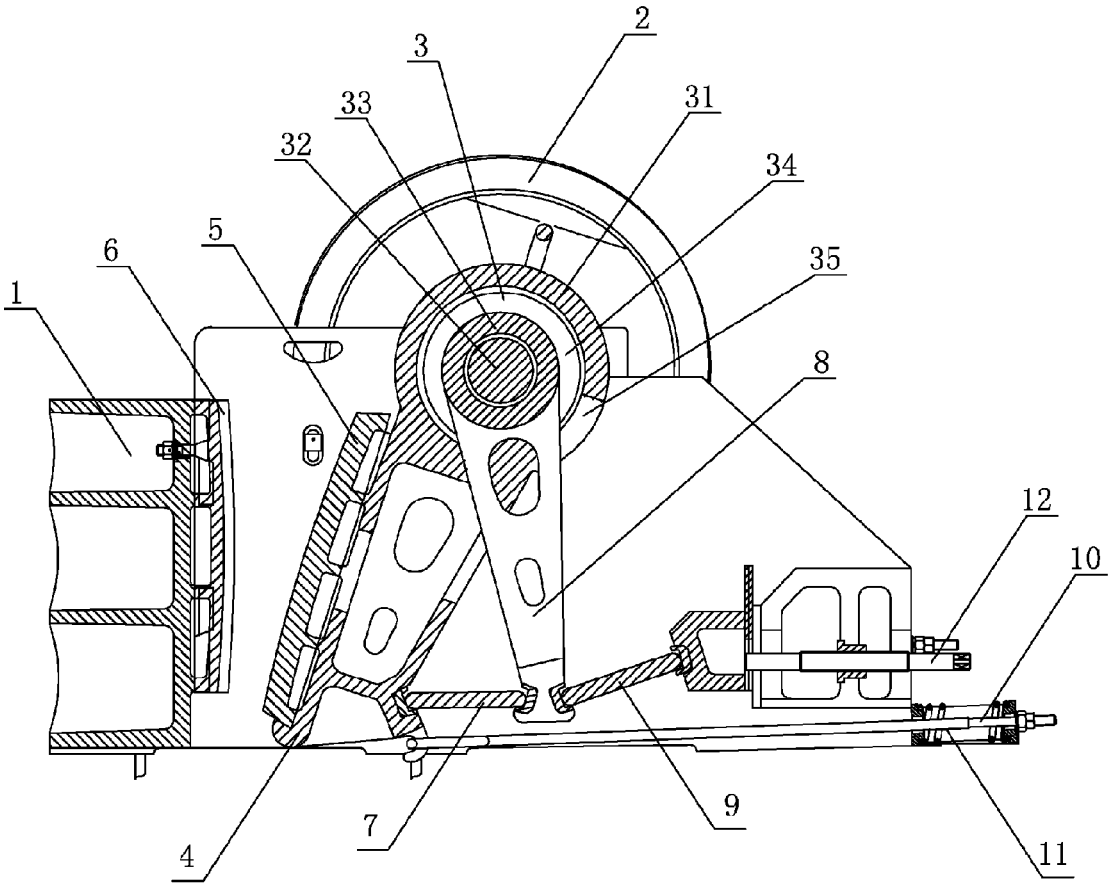
FIG. 7 is a sketch view of a structure of a jaw crusher according to the present invention.

Referring to FIG. 7 of the drawings, a jaw crusher with a double-crank-rocker mechanism is illustrated, comprising:

a frame 1;

a fixed jaw plate 6;

a movable jaw plate 5;

a front crank-rocker mechanism;

a rear crank-rocker mechanism; and a driving wheel 2;

wherein the front crank-rocker mechanism comprises:

a front swinging jaw 4; and a front bracket 7;

wherein the rear crank-rocker mechanism comprises:

a rear swinging jaw 8; and a rear bracket 9.

An eccentric driving shaft 3 is provided on the frame 1 and is connected to the driving wheel 2, comprising:

a shaft cover 31; and an eccentric shaft bar 32;

wherein a camber 34 is provided on a middle of the shaft cover 31 where the eccentric shaft bar 32 is connect, a bearing bush 33 is provided on the eccentric shaft bar 32 in the chamber 34.

The front swinging jaw 4 and the rear swing jaw 8 are pivotally connected to the eccentric driving shaft 3. The front swinging jaw 4 is connected to the shaft cover 31. The rear swinging jaw 8 is connected to the bearing bush 33. An opening 35 is provided on the shaft cover 31 in such a manner that the rear swinging jaw 8 is capable of passing and swinging through the opening 35. A first end of the front bracket 7 is pivotally connected to a bottom rear of the front swinging jaw 4. A second end of the front bracket 7 is pivotally connected to a bottom front of the rear swinging jaw 8. A first end of the rear bracket 9 is pivotally connected to a bottom rear of the rear swinging jaw 8, a second end of the rear bracket 9 is pivotally connected to the frame 1.

The movable jaw plate 5 is mounted on the front swinging jaw 4. The fixed jaw plate 6 is mounted on the frame 1. An adjusting bolt 12 is provided on the frame 1. The adjusting bolt 12 is connected to the rear bracket 9. A connecting rod 10 is connected to the bottom rear of the front swinging jaw 4. The connecting rod 10 is connected to the frame 1 through a buffer spring 11.

Figure 10:
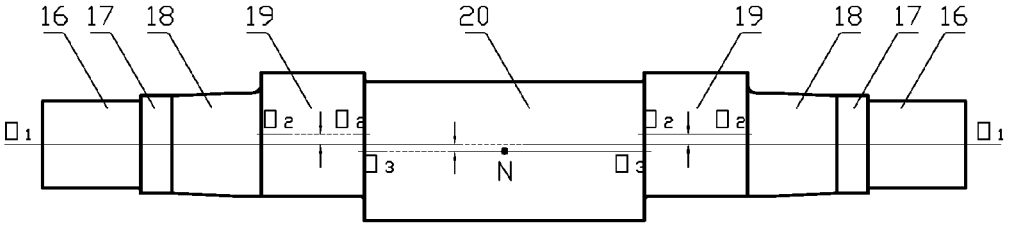
FIG. 10 is sketch view of an eccentric driving shaft according to the present invention.

Referring to FIG. 10 of the drawings, the eccentric driving shaft 3 is a self-balance eccentric shaft, wherein eccentric bearing guards 19, concentric bearing guards 18, locking guards 17 and reference guards 16 are provided equally at two sides of a connection guard 20. Axes of the concentric bearing guards 18, the locking guards 17 and the reference guards 16 coincide with a rotation axis $0_1$-$0_1$ of a total shaft. Axes of the eccentric bearing guards 19 coincide with an eccentric axis $0_2$-$0_2$ of the total shaft. An axis of the connection guard 20 is provided on an opposite side of an eccentric center of the eccentric bearing guard 19 judging from the rotation axis $0_1$-$0_1$. That is to say, a center of mass N of the connection guard 20 coincide with an eccentric axis $0_3$-$0_3$. An eccentric moment of the connection guard 20 equals to an eccentric moment of the eccentric bearing guard 19 in value with opposite directions. A first shaft cover and a second shaft cover are provided on the front swinging jaw 4 and are respectively connected to the eccentric bearing guards 19. The bearing bush 33 of the rear swinging jaw 8 is cased around the connection guard 20. The concentric bearing guards 19 of the eccentric driving shaft 3 are mounted on the frame 1. The driving wheel 2 is cased around the reference guards 16.

Figure 9:
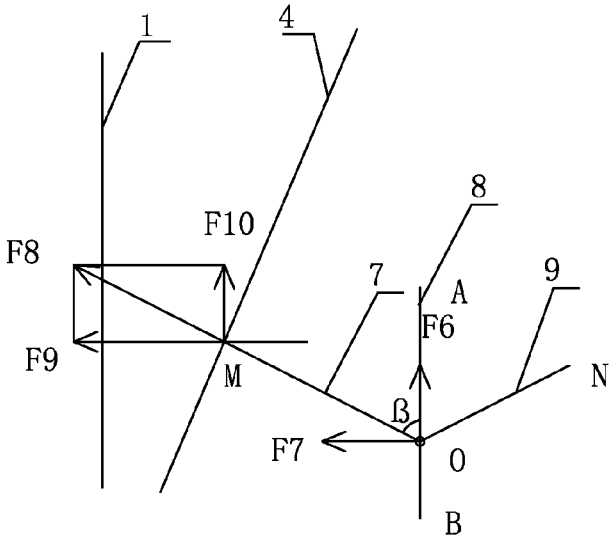
FIG. 9 is a force analysis of a bottom of a swinging jaw of the jaw crusher according to the present invention.

Referring to FIG. 9 of the drawings, for conveniently analyzing and comparing, the rear bracket 9 is removed, and only the front bracket 7 is analyzed (whose results are the same as the rear bracket 9). Because an end of the rear bracket 9 is pivotally connected to the frame 1 (which is also called relatively mounting), line AB in the FIG. 9 is approximately regarded as a straight track (which is actually a curve) for forcing a zero point to move up and down. According to the mechanical principle (parallelogram law), a swinging jaw tension F6 and an AB track thrust F7 form a composition force F8. The F8 can be resolved into a vertical force F9 and a horizontal force F10, wherein the F9 is an effective crushing force. The F10 equals to F6 in value. Obviously, the F9 is larger than the F6. Therefore, a movement of the lower portion of the swinging jaw is always in the state of force increasing effect (because an angle β is large). The above results show that with the double-crank-rocker mechanism, a small force on the rear swinging jaw 8 will lead to a large crushing force on the bottom of the front swinging jaw 4. The higher the rear swinging jaw is (which means the β is larger), the more the crushing force will be increased. This characteristic is very suitable for actual utilization: wherein with the later crushing stroke, the materials are more compact, and the larger crushing force is needed. If the crushing force is large enough, crushing efficiency will be the best.

Application:

The jaw crusher according to the present invention comprises two complete and individual crank-rocker mechanisms, wherein:

A) in the front crank-rocker mechanism, the eccentric drive shaft 3 is a crank, the front swinging jaw 4 is a connecting rod, and the front bracket 7 is a rocker; and B) in the rear crank-rocker mechanism, the eccentric drive shaft 3 is a crank, the rear swinging jaw 8 is a connecting rod, and the rear bracket 9 is a rocker.

The front crank-rocker mechanism and the rear crank-rocker mechanism are provided on the same eccentric driving shaft 3 and cooperate with each other for breaking (or pulling backwards) a pivotal connection point of the front bracket 7 and the frame 1. The rear crank-rocker mechanism is inserted. The bottom rear of the rear swinging jaw 8 is pivotally connected to the front bracket 7. The rear bracket 9 is pivotally connected to the frame 1. Therefore, the jaw crusher with the double-crank-rocker mechanism is formed.

Preferred Embodiment 2

Figure 8:
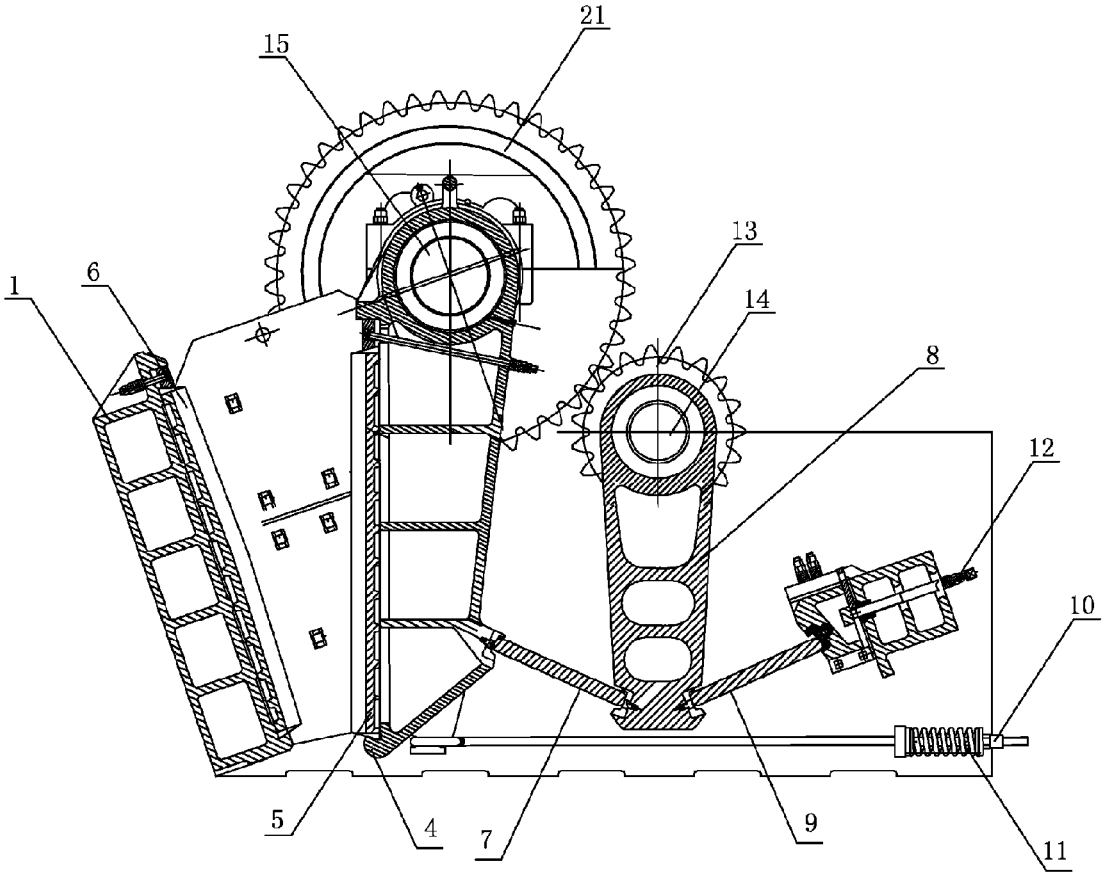
FIG. 8 is a sketch view of another structure of a jaw crusher according to the present invention.

Referring to FIG. 8 of the drawings, a jaw crusher with a double-crank-rocker mechanism is illustrated, comprising:

a frame 1;

a fixed jaw plate 6;

a movable jaw plate 5;

a front crank-rocker mechanism;

a rear crank-rocker mechanism; and a driving wheel 2;

wherein the driving wheel 2 comprises:

a front driving gear 21; and a rear driving gear 13;

wherein the front driving gear 21 is engaged with the rear driving gear 13.

The front crank-rocker mechanism comprises:

a front swinging jaw 4;

a front bracket 7; and a front eccentric driving shaft 15.

The rear crank-rocker mechanism comprises:

a rear swinging jaw 8;

a rear bracket 9; and a rear eccentric driving shaft 14.

The front swinging jaw 4 is pivotally connected to the front eccentric driving shaft 15. The rear swinging jaw 8 is pivotally connected to the rear eccentric driving shaft 14. The front eccentric driving shaft 15 is connected to the driving wheel 2. The rear eccentric driving shaft 14 is connected to the rear driving gear 13. A first end of the front bracket 7 is pivotally connected to a bottom rear of the front swinging jaw 4. A second end of the front bracket 7 is pivotally connected to a bottom front of the rear swinging jaw 8. A first end of the rear bracket 9 is pivotally connected to a bottom rear of the rear swinging jaw 8, a second end of the rear bracket 9 is pivotally connected to the frame 1.

Referring to FIG. 10 of the drawings, the front eccentric driving shaft 15 and the rear eccentric driving shaft 14 are self-balance eccentric shafts, wherein eccentric bearing guards 19, concentric bearing guards 18, locking guards 17 and reference guards 16 are provided equally at two sides of a connection guard 20. Axes of the concentric bearing guards 18, the locking guards 17 and the reference guards 16 coincide with a rotation axis $\mathbf{0}_1$-$\mathbf{0}_1$ of a total shaft. Axes of the eccentric bearing guards 19 coincide with an eccentric axis $\mathbf{0}_2$-$\mathbf{0}_2$ of the total shaft. An axis of the connection guard 20 is provided on an opposite side of an eccentric center of the eccentric bearing guard 19 judging from the rotation axis $\mathbf{0}_1$-$\mathbf{0}_1$. That is to say, a center of mass N of the connection guard 20 coincide with an eccentric axis $\mathbf{0}_3$-$\mathbf{0}_3$. An eccentric moment of the connection guard 20 equals to an eccentric moment of the eccentric bearing guard 19 in value with opposite directions. The front swinging jaw 4 is connected to the eccentric bearing guards 19 of the front eccentric driving shaft 15. The rear swinging jaw 8 is connected to the eccentric bearing guards 19 of the rear eccentric driving shaft 14. The concentric bearing guards 19 of the front eccentric driving shaft 15 and the rear eccentric driving shaft 14 are mounted on the frame. The front driving gear 21 is cased around the reference guards 16 of the front eccentric driving shaft 15, the rear driving gear 13 is cased around the reference guards 16 of the rear eccentric driving shaft 14.

The movable jaw plate 5 is mounted on the front swinging jaw 4. The fixed jaw plate 6 is mounted on the frame 1. An adjusting bolt 12 is provided on the frame 1. The adjusting bolt 12 is connected to the rear bracket 9. A connecting rod 10 is connected to the bottom rear of the front swinging jaw 4. The connecting rod 10 is connected to the frame 1 through a buffer spring 11.

Application:

The jaw crusher according to the present invention comprises two complete and individual crank-rocker mechanisms, wherein:

A) in the front crank-rocker mechanism, the front eccentric drive shaft 15 is a crank, the front swinging jaw 4 is a connecting rod, and the front bracket 7 is a rocker; and B) in the rear crank-rocker mechanism, the rear eccentric drive shaft 14 is a crank, the rear swinging jaw 8 is a connecting rod, and the rear bracket 9 is a rocker.

The front crank-rocker mechanism cooperates with the rear crank-rocker mechanism for breaking (or pulling backwards) a pivotal connection point of the front bracket 7 and the frame 1. The rear crank-rocker mechanism is inserted. The bottom rear of the rear swinging jaw 8 is pivotally connected to the front bracket 7. The rear bracket 9 is pivotally connected to the frame 1. Because the front eccentric driving shaft 15 and the rear eccentric driving shaft 14 rotate synchronously by a same driving wheel, the jaw crusher with the double-crank-rocker mechanism is formed.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A jaw crusher with a double-crank-rocker mechanism, comprising:

a frame;

a fixed jaw plate;

a movable jaw plate;

a crank-rocker device; and a driving wheel;

wherein said fixed jaw plate is mounted on said frame, said movable jaw plate is mounted on said crank-rocker device, said crank-rocker device is provided on said frame and is connected to said driving wheel;

wherein said crank rocker device comprises:

a front crank-rocker mechanism; and a rear crank-rocker mechanism;

wherein said front crank-rocker mechanism comprises:

a front swinging jaw, wherein said movable jaw plate is mounted on the front swinging jaw; and a front bracket;

wherein said rear crank-rocker mechanism comprises:

a rear swinging jaw; and a rear bracket;

wherein said front swinging jaw and said rear swinging jaw are connected to an eccentric drive mechanism, said eccentric drive mechanism is connected to said driving wheel; a first end of said front bracket is pivotally connected to a bottom rear of said front swinging jaw, a second end of said front bracket is pivotally connected to a bottom front of said rear swinging jaw; a first end of said rear bracket is pivotally connected to a bottom rear of said rear swinging jaw, a second end of said rear bracket is pivotally connected to said frame; said movable jaw plate is mounted on said front swinging jaw and is corresponding to said fixed jaw plate for forming a crushing chamber;

wherein said eccentric drive mechanism is a double-eccentric-shaft drive structure, comprising:

a front eccentric driving shaft; and a rear eccentric driving shaft;

wherein said front swinging jaw is connected to said front eccentric driving shaft, said rear swing jaw is connected to said rear eccentric driving shaft, said front eccentric driving shaft and said rear eccentric driving shaft are respectively connected to said driving wheel.

2. The jaw crusher, as recited in claim 1, wherein said driving wheel comprises:

a front driving gear; and a rear driving gear;

wherein said front driving gear is engaged with said rear driving gear, said front eccentric driving shaft is connected to said front driving gear, said rear eccentric driving shaft is connected to said rear driving gear.

3. The jaw crusher, as recited in claim 2, wherein said front eccentric driving shaft has a same structure as said rear eccentric driving shaft, said front eccentric driving shaft and said rear eccentric driving shaft are self-balance eccentric shafts, connection guards are provided in middles of said eccentric driving shafts; eccentric bearing guards, concentric bearing guards, locking guards and reference guards are provided equally at two sides of said connection guard; said front swinging jaw is connected to said eccentric bearing guards of said front eccentric driving shaft, said rear swinging jaw is connected to said eccentric bearing guards of said rear eccentric driving shaft; said concentric bearing guards of said eccentric driving shafts are mounted on said frame; said front driving gear is cased around said reference guards of said front eccentric driving shaft, said rear driving gear is cased around said reference guards of said rear eccentric driving shaft; axes of said concentric bearing guards, said locking guards and said reference guards coincide with a rotation axis of a total shaft, axes of said eccentric bearing guards coincide with an eccentric axis of said total shaft; a center of mass of said connection guard is provided on an opposite side of an eccentric center of said eccentric bearing guard, and an eccentric moment of said connection guard equals to an eccentric moment of said eccentric bearing guard.

4. The jaw crusher, as recited in claim 3, wherein an adjusting bolt is provided on said frame, said adjusting bolt is connected to said rear bracket.

5. The jaw crusher, as recited in claim 4, wherein a connecting rod is connected to said bottom rear of said front swinging jaw, said connecting rod is connected to said frame through a buffer spring.

6. The jaw crusher, as recited in claim 3, wherein a connecting rod is connected to said bottom rear of said front swinging jaw, said connecting rod is connected to said frame through a buffer spring.

7. The jaw crusher, as recited in claim 2, wherein an adjusting bolt is provided on said frame, said adjusting bolt is connected to said rear bracket.

8. The jaw crusher, as recited in claim 2, wherein a connecting rod is connected to said bottom rear of said front swinging jaw, said connecting rod is connected to said frame through a buffer spring.

9. The jaw crusher, as recited in claim 1, wherein an adjusting bolt is provided on said frame, said adjusting bolt is connected to said rear bracket.

10. The jaw crusher, as recited in claim 1, wherein a connecting rod is connected to said bottom rear of said front swinging jaw, said connecting rod is connected to said frame through a buffer spring.

* * * * *